US011506156B1

(12) United States Patent
Weston et al.

(10) Patent No.: US 11,506,156 B1
(45) Date of Patent: Nov. 22, 2022

(54) AIR INDUCTION SYSTEM WATER RELIEF DOOR

(71) Applicant: Ford Global Technologies, LLC, Dearborn, MI (US)

(72) Inventors: Mark Thomas Weston, Livonia, MI (US); Luis Rabasa, Naucalpan (MX); David Thomas McNarney, Beverly Hills, MI (US); George Frederick MacDonald, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/475,926

(22) Filed: Sep. 15, 2021

(51) Int. Cl.

| | |
|---|---|
| ***F02M 35/02*** | (2006.01) |
| ***F02M 35/08*** | (2006.01) |
| ***F02M 35/10*** | (2006.01) |
| ***F02M 35/022*** | (2006.01) |

(52) U.S. Cl.
CPC ..... *F02M 35/088* (2013.01); *F02M 35/0209* (2013.01); *F02M 35/0226* (2013.01); *F02M 35/084* (2013.01); *F02M 35/10111* (2013.01); *F02M 35/10229* (2013.01); *F02M 35/10301* (2013.01)

(58) Field of Classification Search
CPC ..... F02M 35/0209; F02M 35/0226; F02M 35/084; F02M 35/088; F02M 35/10111; F02M 35/10229; F02M 35/10301
USPC ..... 55/355, 385.3
See application file for complete search history.

(56) References Cited

U.S. PATENT DOCUMENTS

| | | | | |
|---|---|---|---|---|
| 6,312,488 | B1 * | 11/2001 | Fischer | F02M 35/088 55/315 |
| 7,069,893 | B2 | 7/2006 | Cusumano et al. | |
| 8,281,887 | B2 | 10/2012 | Khouw et al. | |
| 2021/0207562 | A1 * | 7/2021 | Olsson | F02M 35/0223 |
| 2021/0221198 | A1 * | 7/2021 | Kaltsounis | F02M 35/10013 |
| 2021/0237756 | A1 * | 8/2021 | Thompson | G01F 23/282 |

FOREIGN PATENT DOCUMENTS

| | | | | |
|---|---|---|---|---|
| CN | 107917024 | A | 4/2018 | |
| GB | 2365064 | A | 2/2002 | |
| WO | WO-2011031192 | A1 * | 3/2011 | B01D 45/06 |
| WO | WO-2019238217 | A1 * | 12/2019 | B01D 45/08 |

* cited by examiner

*Primary Examiner* — Erick R Solis
(74) *Attorney, Agent, or Firm* — Vincent Mastrogiacomo; Brooks Kushman, P.C.

(57) ABSTRACT

An air intake assembly has an inlet member, a fluid reservoir, and an outlet. The inlet member defines a generally vertical oriented first fluid channel. The first fluid channel has a vertically extending portion, an upper inlet end, and a lower end. The fluid reservoir has an upper region that defines a second fluid channel. The fluid reservoir is attached to a lower end of the inlet member such that the first fluid channel vertically extending portion is substantially perpendicular to the second fluid channel. The fluid reservoir has an outlet defined by an aperture in a lower region of the fluid reservoir which forms a liquid collector. The trapdoor is pivotably attached to the fluid reservoir adjacent to the outlet. The rigid trapdoor is configured to open when exposed to a predetermined open force value to allow liquid to escape the liquid collector.

20 Claims, 4 Drawing Sheets

AIR INDUCTION SYSTEM WATER RELIEF DOOR

TECHNICAL FIELD

The present disclosure relates to systems and methods of aspirating a vehicle engine.

BACKGROUND

When building an off-road vehicle to excel at both high-speed desert running and full water wading, the systems needed to meet these two objectives can seem to be mutually exclusive. Namely, to meet the optimal objectives for high-speed desert running, the engine needs to meet horsepower and torque levels which marketing and engineering have deemed necessary. For the engine to reach this power, it must have a free-flowing Air Induction System (AIS). There are solutions where a customer can add and subtract parts to a vehicle to meet the needs of a certain excursion. In one system, a "snorkel" may be added onto vehicles where traversing deep water is desired. However, said system may require undesirable end-user assembly/disassembly.

SUMMARY

Presented are systems and methods of sorting fluid mixtures containing air and non-air fluids such that the air is introduced to a vehicle engine and the non-air fluids are removed from the fluid mixtures via a trapdoor.

One embodiment is an air intake assembly for an internal combustion engine. The air intake assembly comprises an inlet member, a fluid reservoir, and a trapdoor. The air inlet defines a first fluid channel. The first fluid channel has a vertically extending portion, an upper inlet end, and a lower end. The fluid reservoir has an upper region that defines a second fluid channel. The fluid reservoir is attached to a lower end of the inlet member such that the first fluid channel vertically extending portion is substantially perpendicular to the second fluid channel. The fluid reservoir has an outlet defined by an aperture in a lower region of the fluid reservoir which forms a liquid collector. The trapdoor is pivotably attached to the fluid reservoir adjacent to the outlet. The rigid trapdoor is configured to open when exposed to a predetermined open force value to allow liquid to escape the liquid collector.

Another embodiment is an engine aspiration method. The engine aspiration method comprises drawing a fluid mixture downwardly into a generally vertical oriented first fluid channel. The method further comprises drawing the fluid mixture into a channel joint in fluid communication with a generally non-vertical oriented second fluid channel and a liquid collector disposed below the channel joint, such that a gas fluid within the fluid mixture would upwardly flow into the second fluid channel and non-gas fluid within the fluid mixture would flow into the liquid collector in which a first portion of weight of the non-gas fluid would be supported by a trapdoor. Further, the method comprises releasing the non-gas fluid out of the trapdoor in response to the trapdoor being exposed to a predetermined bias force differential value defined by a vacuum force value and the first portion of weight.

A third embodiment is a vehicle. The third embodiment comprises an air intake, a fluid reservoir, an outlet, and a vehicle engine. The air intake defines a first fluid channel. The fluid reservoir defines a second fluid channel. The reservoir interacts with the intake such that the first fluid channel and second channel form a channel joint and are in fluid communication. The outlet has a liquid collector, a duct extending from the liquid collector, and a trap door. The liquid collector defines a third fluid channel and an aperture. The trapdoor is configured to partially seal the aperture. The vehicle engine is configured to produce a vacuum force value. The vacuum force causes a fluid mixture flow from atmosphere through the first fluid channel into the channel joint and air within the fluid mixture to flow into the second fluid channel, while gravity causes water within the fluid mixture to flow from the channel joint into the liquid collector and out of the trapdoor in response to the trapdoor being exposed to a predetermined bias force differential value defined by the vacuum force value and a portion of the weight of the water.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
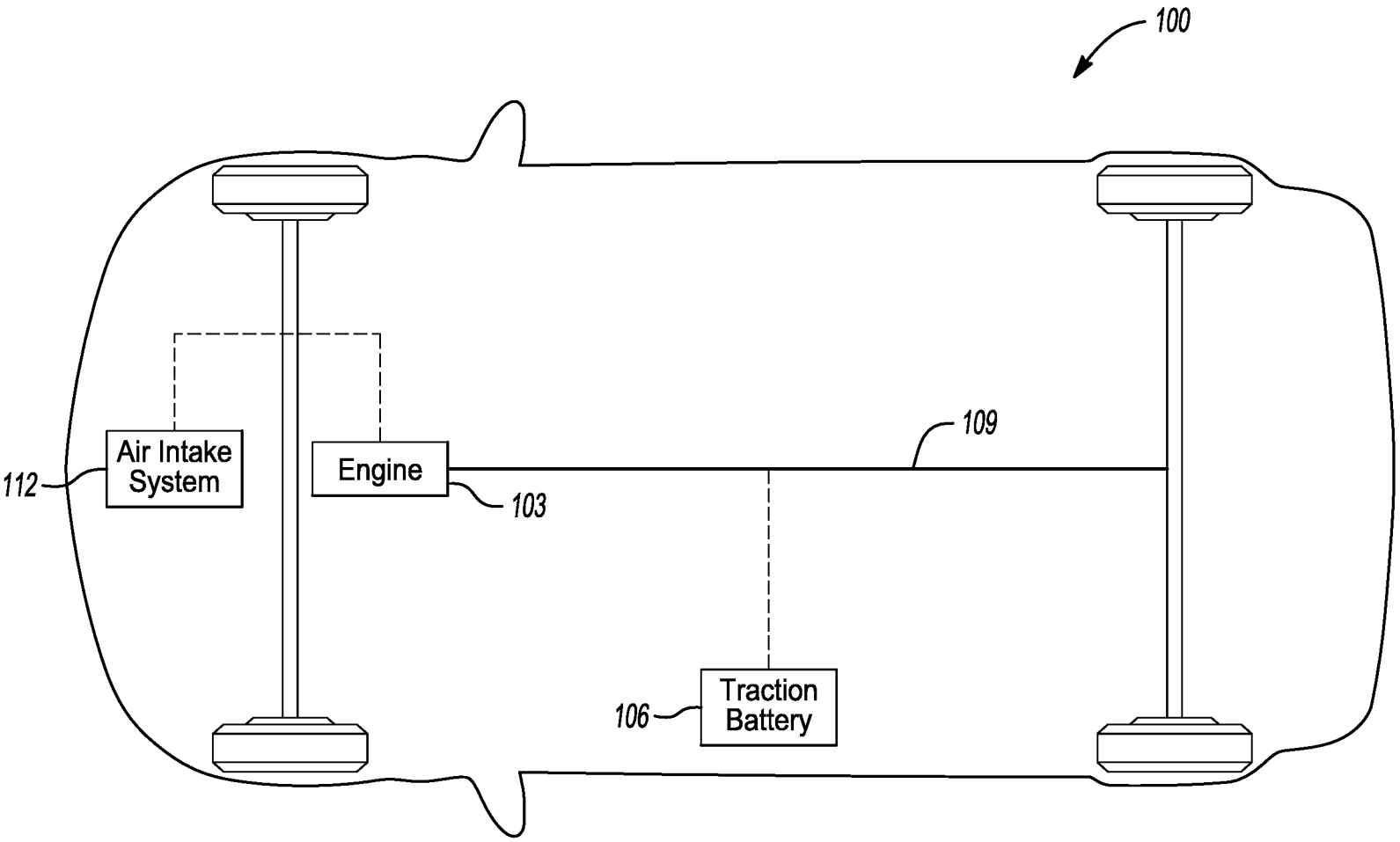
FIG. 1 illustrates a vehicle.

FIG. 1 illustrates a vehicle 100. The vehicle 100 has an engine 103. The engine 103 may be used to provide torque to a propulsion system within the vehicle 100. The engine 103 may convert chemical energy from a fuel source into mechanical energy. In particular, the engine 103 may provide mechanical energy in the form of rotational energy exerted upon a crankshaft. The engine 103 may be configured to provide the mechanical energy to a transmission through the crankshaft. The engine 103 may be in communication with a vehicle controller. The engine 103 may include a plurality of sensors. One of the sensors may determine and provide engine 103 parameters to a vehicle controller. For example, an engine 103 sensor may determine and provide engine 103 speed, fuel economy, lubricant level, or other engine 103 parameters.

Some embodiments of the vehicle 100 have a vehicle battery 106. The vehicle battery 106 may be used to provide torque to a propulsion system within the vehicle 100. The vehicle battery 106 may be a traction battery. The vehicle battery 106 may be used to store electrical energy. Further, the vehicle battery 106 may be used to convert the stored electrical energy into mechanical energy to propel the vehicle 100. The vehicle battery 106 may include a plurality of battery cells. In some embodiments, at least two of the battery cells of the plurality of battery cells are resistively sequential. In such embodiments, the electrical potential of both of the battery cells may be summed. Alternatively, or additionally, at least two of the battery cells of the plurality of battery cells are resistively parallel. The vehicle battery 106 may have a plurality of sensors. One of the sensors may determine and provide battery parameters to a vehicle controller.

As illustrated, the vehicle 100 comprises a drivetrain 109. The drivetrain 109 may be in at least one of electrical, magnetic, and mechanically in communication with at least one of an internal combustion engine 103, an electric power source, and a regenerative braking system. In some embodiments, the drivetrain 109 may be in fluid communication with the internal combustion engine 103. For example, the vehicle 100 may have a torque converter between the drivetrain 109 and the internal combustion engine 103. Alternatively, the vehicle 100 may have a clutch between the drivetrain 109 and the internal combustion engine 103.

The vehicle 100 may include an air intake assembly 112. The air intake assembly 112 may be in fluid communication with the engine 103. The air intake assembly 112 may be configured to provide air from atmosphere to the engine 103.

Figure 2:
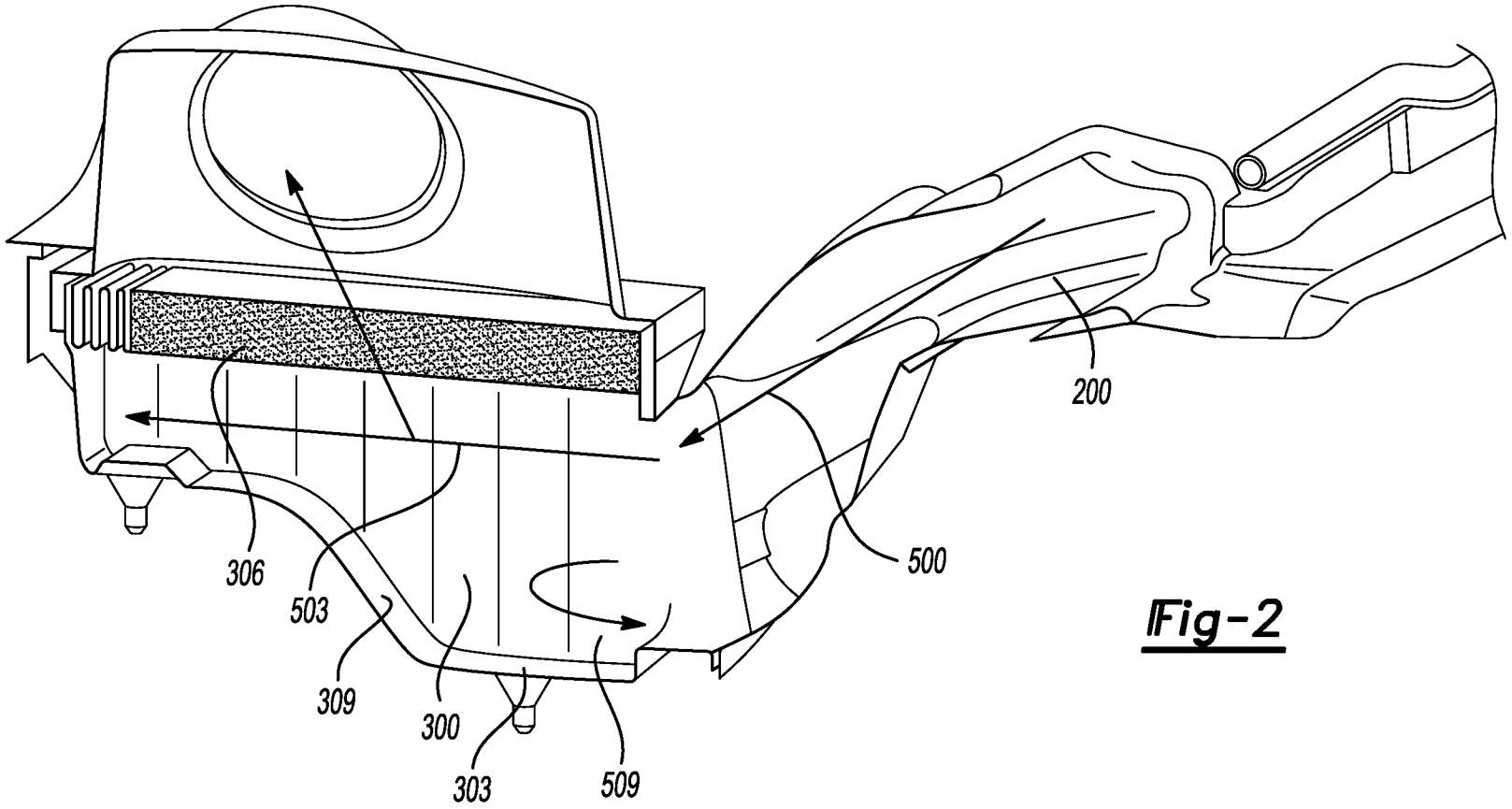
FIG. 2 illustrates a cross-section view of an air intake assembly.

FIG. 2 illustrates a cross-section view of the air intake assembly 112. The air intake assembly 112 comprises an inlet member 200, a fluid reservoir 300, and an outlet 400. The inlet member 200 may be configured to collect and transfer fluid from atmosphere to the engine 103. In some situations, the inlet member 200 may receive a fluid mixture. The fluid mixture may be comprised of a plurality of fluids. For example, in rainy weather, the inlet member 200 may receive a mixture of air and rainwater. As another example, in off-road conditions, the inlet member 200 may receive both high-standing water and air. Even further the inlet member 200 may receive both sand and air. The transfer of fluids may be partially facilitated by a first fluid channel 500. The first fluid channel 500 may be defined by the inlet member 200. The inlet member may be comprised of an upper inlet end and a lower inlet end. The first fluid channel may be defined by one of the upper and lower ends of the inlet. The upper end of the inlet may be disposed at a greater vertical angle than the lower end. As such, the upper end may be higher in elevation than the lower end. As shown, the first fluid channel 500 may be generally vertical oriented. In such an embodiment, the first fluid channel 500 may be configured to transfer a fluid mixture at a downward angle. The inlet member 200 may be configured to interface with a fluid reservoir 300. In one embodiment, the inlet member 200 may be configured to fluidly communicate with a fluid reservoir 300 via the first fluid channel 500.

The fluid reservoir 300 may be configured to receive fluid from the inlet member 200. The fluid reservoir 300 may be configured to adjust the parameters and composition of fluids within the reservoir for compatibility with the engine 103. For example, the reservoir may be configured to at least one of decrease fluid speed, divide fluid speed, and other fluid parameter adjustment. Further, the reservoir may be configured to separate fluids based on compatibility to with the engine 103. For example, the reservoir may be configured to sort water and air from the fluid mixture before sending the air to the engine 103. As such, the reservoir may comprise an air filter 306. The air filter 306 may be comprised of a perforated material. The perforations may be configured to generally inhibit transference of water, dirt, and other debris through the material, while permitting transference of air molecules through the material.

The fluid reservoir 300 comprises a second fluid channel 503. The second fluid channel 503 may be at least partially defined by the fluid reservoir 300. The second fluid channel 503 may be configured to join with the first fluid channel 500 of the inlet member 200. When joined, the first fluid channel 500 and second fluid channel 503 may form a channel joint 509. In such an embodiment, the engine 103 may be in fluid communication with atmosphere via the first fluid channel 500, the second fluid channel 503, and the channel joint 509. As depicted, the first fluid channel 500 forms an obtuse angle with the second fluid channel 503. In some embodiments, when the inlet member 200 is interacting with the fluid reservoir 300 the first fluid channel 500 may be disposed generally perpendicular to the second fluid channel 503. In other embodiments the second fluid channel 503 may be generally non-vertically oriented. A portion in which the first and second fluid channel 503 connect may form the channel joint 509. The channel joint 509 may be defined by the volume in which a portion of the fluid mixture is redirected from downward to one of upward or horizontal. The fluid reservoir 300 may define a guidance surface 309. The guidance surface 309 may be configured to direct fluid from within the fluid reservoir 300 towards the channel joint 509. Additionally, or alternatively, the guidance surface 309 may direct the fluid towards a liquid collector. The guidance surface 309 may be sloped. As such, the guidance surface 309 may use gravity to direct fluid towards the one of the liquid collector and the channel joint 509.

Figure 3:
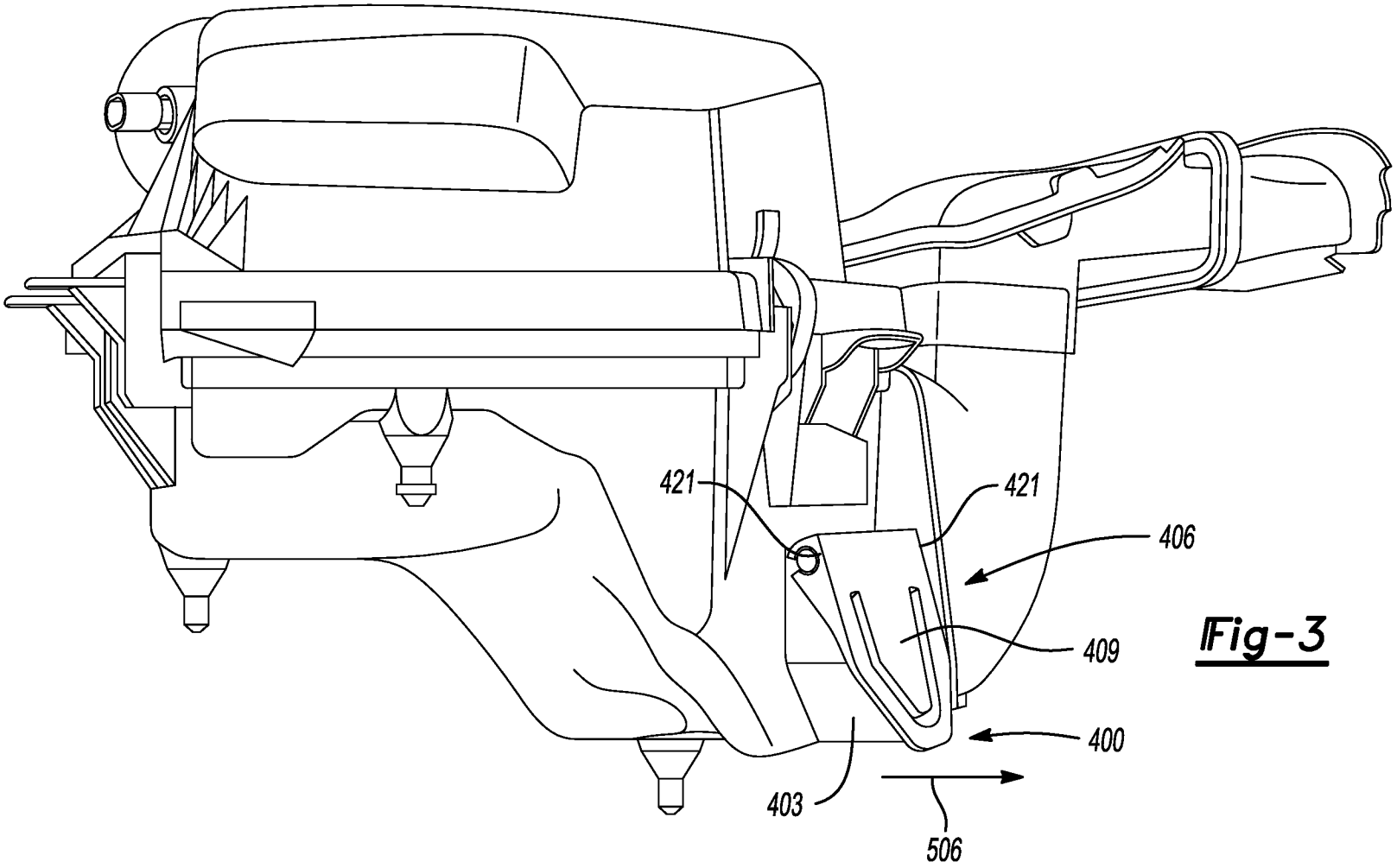
FIG. 3 illustrates an outward view of the intake assembly.

FIG. 3 illustrates an outward view of the intake assembly. The outlet 400 may be configured to release at least one of the fluids of the fluid mixture. The outlet 400 may be defined by the liquid collector 303, a fluid duct 403 defining a third fluid channel 506, a fluid aperture 406, and a trapdoor 409. The liquid collector 303 may be in fluid communication with the channel joint 509. In some embodiments, the liquid collector 303 may be partially defined by the fluid reservoir 300. The liquid collector 303 may be configured to receive and store/hold at least one of fluids of the fluid mixture received within the channel joint 509. For example, the liquid collector 303 may be configured to hold water from a water/air fluid mixture.

The fluid duct 403 may define a third fluid channel 506 and a fluid aperture 406. Some embodiments may not include a fluid duct 403. In such embodiments, the fluid aperture 406 may be defined by the fluid reservoir 300. In particular, the fluid aperture 406 may be defined by a portion of the fluid reservoir 300 that also partially defines the liquid collector 303. As such, the outlet 400 may be in fluid communication with the fluid reservoir 300 via the fluid aperture 406.

The fluid duct 403 defines a plurality of pins 421. The plurality of pins 421 are configured to support the trapdoor 409. The plurality of pins 421 may define pins of various shapes. As depicted, one of the plurality of pins 421 is teardrop in shape, while anther is circular in shape. Even further, in other embodiments, the one of the plurality of pins 421 may be rectangular in shape.

The trapdoor 409 is configured to partially seal the fluid aperture 406. As such, the trapdoor 409 may be sized greater than the area of the fluid aperture 406. Further, the trapdoor 409 may be shaped such that at least one surface of a plurality of surfaces defined by the trapdoor 409 is generally the same shape as the fluid aperture 406. In embodiments of the outlet 400 defining a third fluid channel 506, the third fluid channel 506 may extend from the fluid aperture 406. Further, while not limited to this shape, the third fluid channel 506 may be generally shaped as the fluid aperture 406. With regard to the relation of shape of the third fluid channel 506 to the fluid aperture 406, in embodiments having a third fluid channel 506, the trapdoor 409 may be configured to at least partially seal an open end of the third fluid channel 506.

Figure 4A:
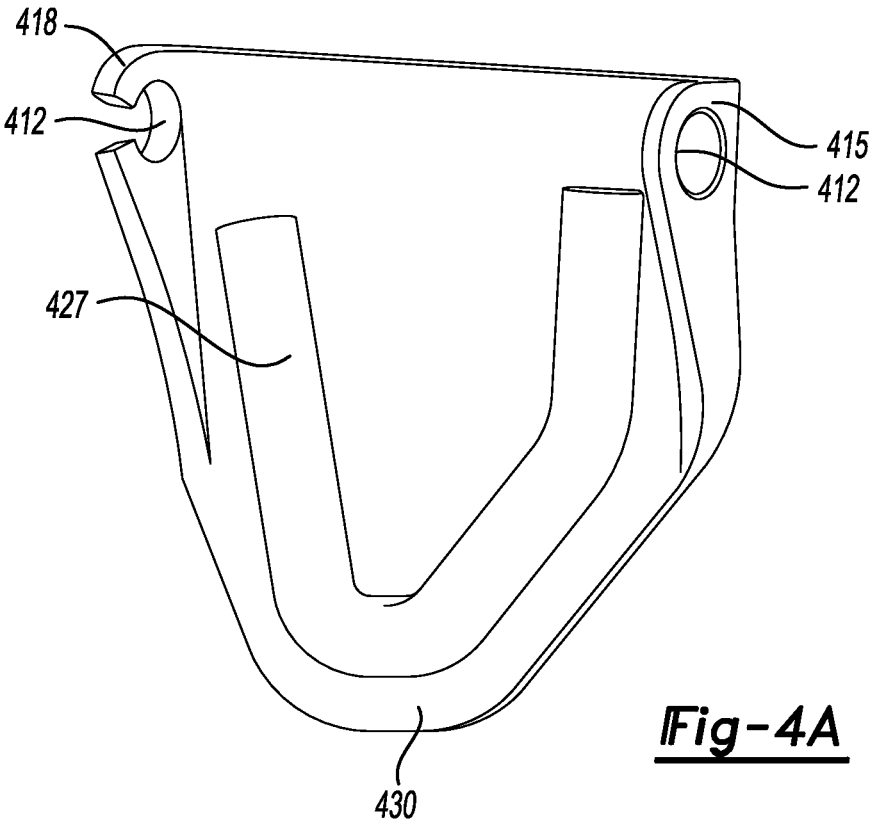
FIGS. 4A and 4B illustrate a front and back view of a trapdoor.
Figure 4B:
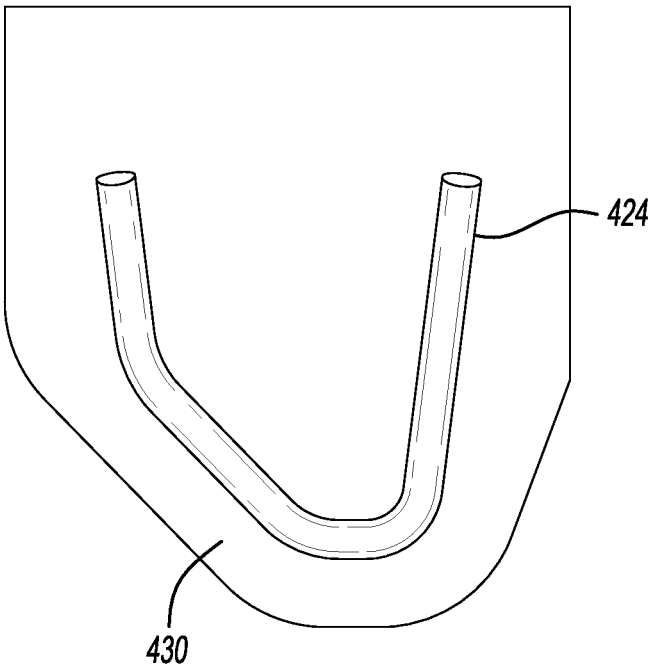

FIGS. 4A and 4B illustrate a front and back view of the trapdoor 409. The trapdoor 409 may be comprised of a rigid material. The rigid material may allow the trapdoor 409 to hold its shape during opening. The rigid material may further allow for a generally digital actuation of the trapdoor 409. In particular, a distal end of the trapdoor 409 will need to have a non-zero angle relative to the one of the fluid aperture 406 and the open end of the third fluid channel 506 for fluid to exit the intake assembly. In such a configuration, trapdoor actuation is easily tuned in comparison to a non-rigid trapdoor 409.

The trapdoor 409 may be configured to respond to a plurality of biasing forces. A first biasing force may be a release force. The release force may be defined by the weight of non-gas fluid within the fluid pocket. The fluid pocket may be configured to allow at least a portion of the weight within from the non-gas fluid to press against the trapdoor 409. A second biasing force may be a hold force. The hold force may be partially comprised by a portion of the weight of the door. In some embodiments, the trapdoor 409 may be disposed on the one of the fluid aperture 406 and third fluid channel 506 in a non-perpendicular slope, such that a portion of the weight is supported by at least one of the fluid duct 403 and the fluid reservoir 300. Another example may be a hold force produced by a spring disposed between the trapdoor 409 and one of the fluid reservoir 300 and the fluid duct 403. The spring may be configured to exert a spring force on the trapdoor 409. Even further, another example of a hold force may be a vacuum force within the fluid reservoir 300 acting on the door. The vacuum force may be generated by the engine 103.

The trapdoor 409 may comprise a plurality of hinge members 412. The plurality of hinge members 412 may be configured to interact and receive support from the plurality of pins 421. One hinge member of the plurality of hinge members 412 may be opposite to another hinge member of the plurality of hinge members 412. In one embodiment, the plurality of hinge members 412 includes a closed hinge, and an open hinge opposite the closed hinge. The closed hinge member 415 may define a complete circular aperture, while the open hinge member 418 may define an open ring aperture. The open hinge member 418 may be configured to snap around a teardrop shaped pin. In other embodiments, the open hinge member 418 may be configured to snap around a rectangular shaped pin. The closed hinge may firmly secure the trapdoor 409 to the one of the fluid reservoir 300 and the third fluid channel 506, while the open hinge may secure the trapdoor 409 while allowing play between the trapdoor 409 and the one of the fluid duct 403 and the fluid reservoir 300.

The trapdoor 409 defines a sealing surface 433. The sealing surface 433 may be configured to interface with at the fluid aperture 406. The sealing surface 433 may define a convex portion 427. The convex portion 427 may be partially shaped similar to the fluid aperture 406. The convex portion 427 may be sized slightly smaller than the at least one of the fluid aperture 406 and the third fluid channel 506. The protrusion of the convex portion 427 may be a round curve. The round curve of the protrusion may serve as a guiding member to the trapdoor 409 when closing. Further, the convex portion 427 may assist sealing the door. For example, the protrusion of the convex portion 427 may increase the surface area in proximity to the one of the liquid collector 303 and the fluid duct 403. The trapdoor 409 may define an outward surface 436. The outward surface 436 may be opposite the sealing surface 433. The outward surface 436 may define a concave portion 424. The concave portion 424 may be generally opposite the convex portion 427. In some embodiments, the convex portion 427 of the trapdoor 409 may be formed by installing the concave portion 424 of the trapdoor 409. The trapdoor 409 may comprise a flanged portion 430. The flanged portion 430 may be sized greater than the one of the fluid aperture 406 and third fluid channel 506. In some embodiments, the flanged portion 430 may be configured to generally seal the one of the fluid aperture 406 and third fluid channel 506 when the convex portion 427 is within the one of fluid aperture 406 and third fluid channel 506.

The trapdoor 409 may be configured to actuate in response to the difference between the release force and the hold force being greater than a predetermined open force value. As the engine 103 changes in rpm the vacuum force may also change. As such, the predetermined open force value may be based in part on an idle rpm vacuum force, generated when the engine 103 is idling.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An air intake assembly for an internal combustion engine, comprising:

an inlet member defining a first fluid channel, having a vertically extending portion, an upper inlet member end and a lower end;

a fluid reservoir having an upper region defining a second fluid channel, the fluid reservoir being attached to a lower end of the inlet member such that the first fluid channel vertically extending portion is substantially perpendicular to the second fluid channel, the fluid reservoir having an outlet defined by an aperture in a lower region of the fluid reservoir which forms a liquid collector; and a rigid trapdoor pivotably attached to the fluid reservoir adjacent the outlet configured to open when exposed to a predetermined open force value to allow liquid to escape the liquid collector.

2. The air intake assembly of claim 1, further comprising an air filter disposed within the reservoir and in fluid communication with atmosphere via the second fluid channel.

3. The air intake assembly of claim 1, wherein the reservoir defines a sloped guiding surface configured to direct fluid toward the outlet.

4. The air intake assembly of claim 1, wherein the lower region defines a pin configured to interface with at least one hinge member of a plurality of hinge members defined by the trapdoor.

5. The air intake assembly of claim 4, wherein the pin defines a teardrop cross-section, and wherein the at least one hinge member of the plurality of hinge members defines an open ring, such that after translation in a first direction of the at least one hinge member of the plurality of hinge members onto the pin surpasses a predetermined threshold, the pin inhibits translation in a second direction opposite of the first direction.

6. The air intake assembly of claim 4, wherein the pins are sized to allow translation of the trapdoor below a predetermined play threshold.

7. The air intake assembly of claim 1, wherein the aperture is generally non-vertically oriented, such that when the trapdoor is in a closed position, a portion of a weight of the trapdoor is supported by the lower region, and wherein the predetermined open force value is further defined by the portion of the weight.

8. The air intake assembly of claim 1, wherein the outlet further comprises a spring attached to the trapdoor and the lower region, and wherein the predetermined open force value is further defined by a spring force.

9. The air intake assembly of claim 1, wherein the trapdoor defines a concave portion sized to fit within the aperture.

10. The air intake assembly of claim 9, wherein the concave portion is round, such that the concave portion serves as a guiding member when closing the trapdoor.

11. An engine aspiration method comprising:

drawing a fluid mixture downwardly into a generally vertical oriented first fluid channel;

drawing the fluid mixture into a channel joint in fluid communication with a generally non-vertical oriented second fluid channel and a liquid collector disposed below the channel joint, such that a gas fluid within the fluid mixture would upwardly flow into the second fluid channel and non-gas fluid within the fluid mixture would flow into the liquid collector in which a first portion of weight of the non-gas fluid would be supported by a trapdoor; and releasing the non-gas fluid out of the trapdoor in response to the trapdoor being exposed to a predetermined bias force differential value defined by a vacuum force value and the first portion of weight.

12. The engine aspiration method of claim 11, further comprising drawing the fluid mixture through an air filter disposed within the second fluid channel.

13. The engine aspiration method of claim 11, wherein the second fluid channel is defined by a fluid reservoir, and further comprising gravitationally redirecting a non-gas fluid from the second fluid channel to the liquid collector via a sloped guidance surface.

14. The engine aspiration method of claim 11, wherein the trapdoor is in a generally non-vertical orientation when in a closed state, and wherein the predetermined bias force differential value is further defined by a second portion of the weight of the trapdoor.

15. The engine aspiration method of claim 11, wherein the trapdoor is connected to one of an outlet fluid duct and a fluid reservoir via a spring, and wherein the predetermined bias force differential value is further defined by a spring force of the spring.

16. A vehicle comprising:

an air intake defining a first fluid channel;

a fluid reservoir defining a second fluid channel, the reservoir interacting with the intake such that the first fluid channel and second fluid channel form a channel joint and are in fluid communication;

an outlet having a liquid collector, a fluid duct extending from the liquid collector and defining a third fluid channel and an aperture, and a trapdoor configured to partially seal the aperture; and a vehicle engine configured to produce a vacuum force value causing a fluid mixture flow from atmosphere through the first fluid channel into the channel joint and air within the fluid mixture to flow into the second fluid channel, while gravity causes water within the fluid mixture to flow from the channel joint into the liquid collector and out of the trapdoor, in response to the trapdoor being exposed to a predetermined bias force differential value defined by the vacuum force value and a portion of a weight of the water.

17. The vehicle of claim 16, wherein the outlet further comprises a plurality of pins disposed on the fluid configured to interact with a plurality of hinge members disposed on the trapdoor.

18. The vehicle of claim 17, wherein at least one hinge member of the plurality of hinge members defines an open ring, and wherein at least one of the pins of the plurality of pins defines a teardrop cross-section.

19. The vehicle of claim 16, wherein the trapdoor defines a concave portion sized to fit within the aperture.

20. The vehicle of claim 19, wherein the concave portion is round, such that the concave portion serves as a guiding member when closing the trapdoor.

* * * * *